United States Patent [19]

Berney

[11] 4,259,737

[45] Mar. 31, 1981

[54] ELECTRONIC WATCH

[75] Inventor: Jean-Claude Berney, Epalinges, Switzerland

[73] Assignee: Jean-Claude Berney SA, Epalinges, Switzerland

[21] Appl. No.: 56,799

[22] Filed: Jul. 11, 1979

[30] Foreign Application Priority Data

Jul. 13, 1978 [CH] Switzerland ..... 7613/78

[51] Int. Cl.[3] ..... G04B 19/04; G04F 10/00; G04B 10/04

[52] U.S. Cl. ..... 368/66; 368/76; 368/111; 368/112

[58] Field of Search ..... 58/23 D, 23 R, 23 BA, 58/38 R, 38 A, 39.5, 152 H; 235/92 T; 324/186; 368/64, 76, 111, 112

[56] References Cited

U.S. PATENT DOCUMENTS 3,854,277 12/1974 Samejima et al. ..... 58/152 R 3,898,790 8/1975 Takamune et al. ..... 58/152 H 4,014,164 3/1977 Fujita ..... 58/152 H

*Primary Examiner*—Edith S. Jackmon

*Attorney, Agent, or Firm*—Wender, Murase & White

[57] ABSTRACT

An electronic timepiece with analog display by seconds, minutes, and hours hands driven by a bidirectional stepping motor, in which the seconds hand can be used to display information different from the seconds count, the time displayed by the minutes and hours hands being conserved and the passage from one information mode to the next being made by a rapid bidirectional catching up. The electronic circuit comprises means for comparison (10) comparing the information delivered by counting means (16, 18) synchronous with the seconds hand and the information to be displayed, delivered by selection means (5, 9, 12). The state of the output of the comparison means (10) acts by control means (FF6, 7) on the stepping motor, so that the seconds hand displays the desired information.

4 Claims, 2 Drawing Figures

ELECTRONIC WATCH

BACKGROUND OF THE INVENTION

The present invention concerns an electronic watch with analog display by means of seconds, minutes and hours hands driven by a bidirectional stepping motor.

It has already been proposed, in an electronic watch comprising a stepping motor having a single direction of rotation for driving, via a gear train, seconds, minutes and hours hands, to use the seconds hand for momentarily displaying, on demand, information other than the seconds, such as the position of an electronic trimmer or an alarm time. However, as the hands can only be displayed in a clockwise direction, several pieces of information cannot be displayed successively without creating a deviation of several minutes from the correct display of the time. Likewise, immediate return to the display of the correct time cannot be effected after having displayed the desired information.

The object of the invention is to remedy these disadvantages.

SUMMARY OF THE INVENTION

According to the present invention there is provided an electronic watch with an alalog display by means of seconds, minutes and hours hands driven by a bidirectional stepping motor, comprising a quartz crystal oscillator, a frequency divider, circuits for effecting a time function and at least one auxiliary function, a circuit for controlling the motor, means for locating the position of the seconds hand and means for comparing information delivered by the locating means and information corresponding to the value of said functions, the comparing means operating on the control circuit of the motor in such a manner that the position of the seconds hand always corresponds to the value of one of said functions.

The present invention will be described further, by way of example, with reference to the accompanying drawings.

DESCRIPTION OF THE PREFERRED EMBODIMENT

Figure 1:
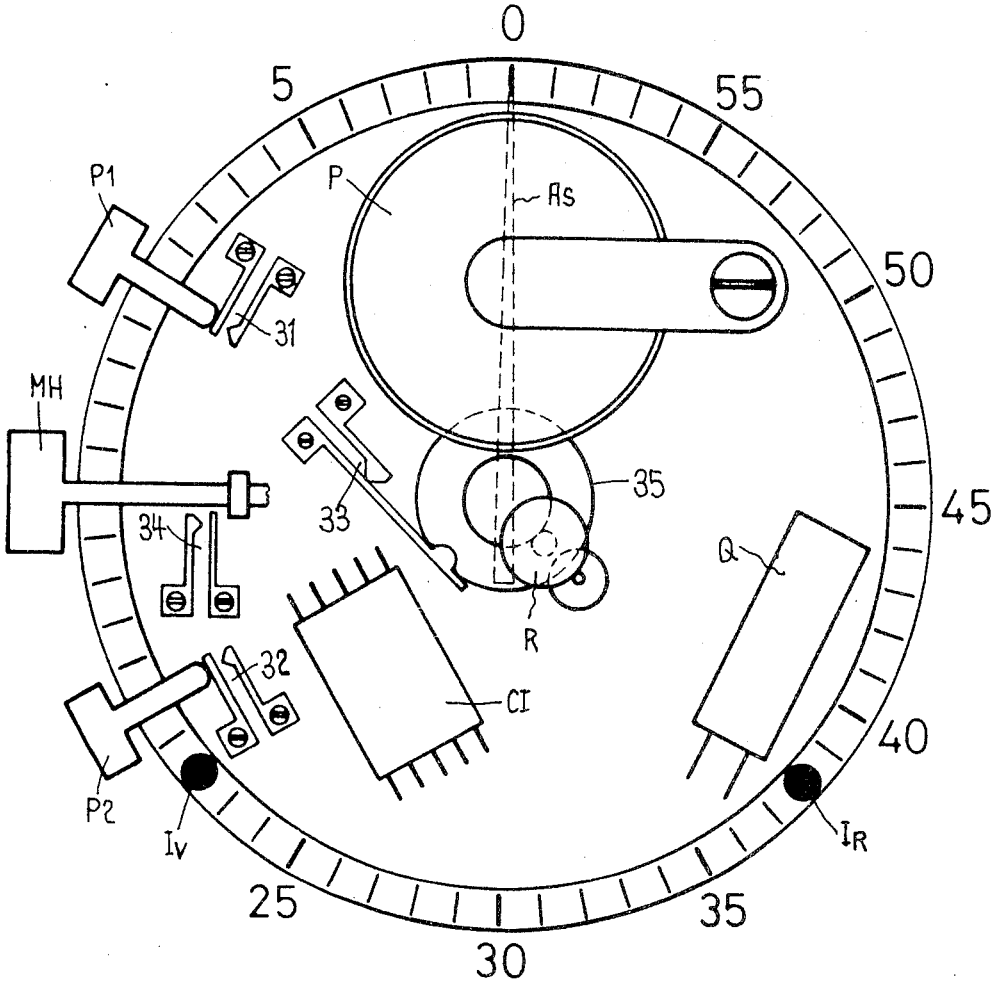
FIG. 1 is a diagrammatic representation of the main components of one embodiment of an electronic watch in accordance with the present invention, viewed from below.

In FIG. 1 there is shown an electric power source P and a quartz crystal resonator Q. The motor, not shown, is of known type, monophase or multiphase, which can be controlled to turn in one direction or in the other, and it engages a gear train R by means of a pinion and via the gear train R drives a seconds hand As, as well as minutes and hours hands, not shown. The gear train R also drives a cam 35 operating a contact 33 which closes when the seconds hand passes, in any direction, through the position 0 of the dial. The control and the time setting means comprise a time setting stem MH operating a time setting contact 34 and, having several axial positions for the mechanical adjustment of the hands, a first pushbutton P1 operating a contact 31, and a second pushbutton P2 operating a contact 32. The different members are connected to appropriate inputs of an integrated circuit CI via an interface circuit, e.g., a printed circuit, not shown. The dial carries two indices: one green index Iv corresponding to the position 22 of the seconds scale, and a red index Ir corresponding to the position 38 of the seconds scale.

Figure 2:
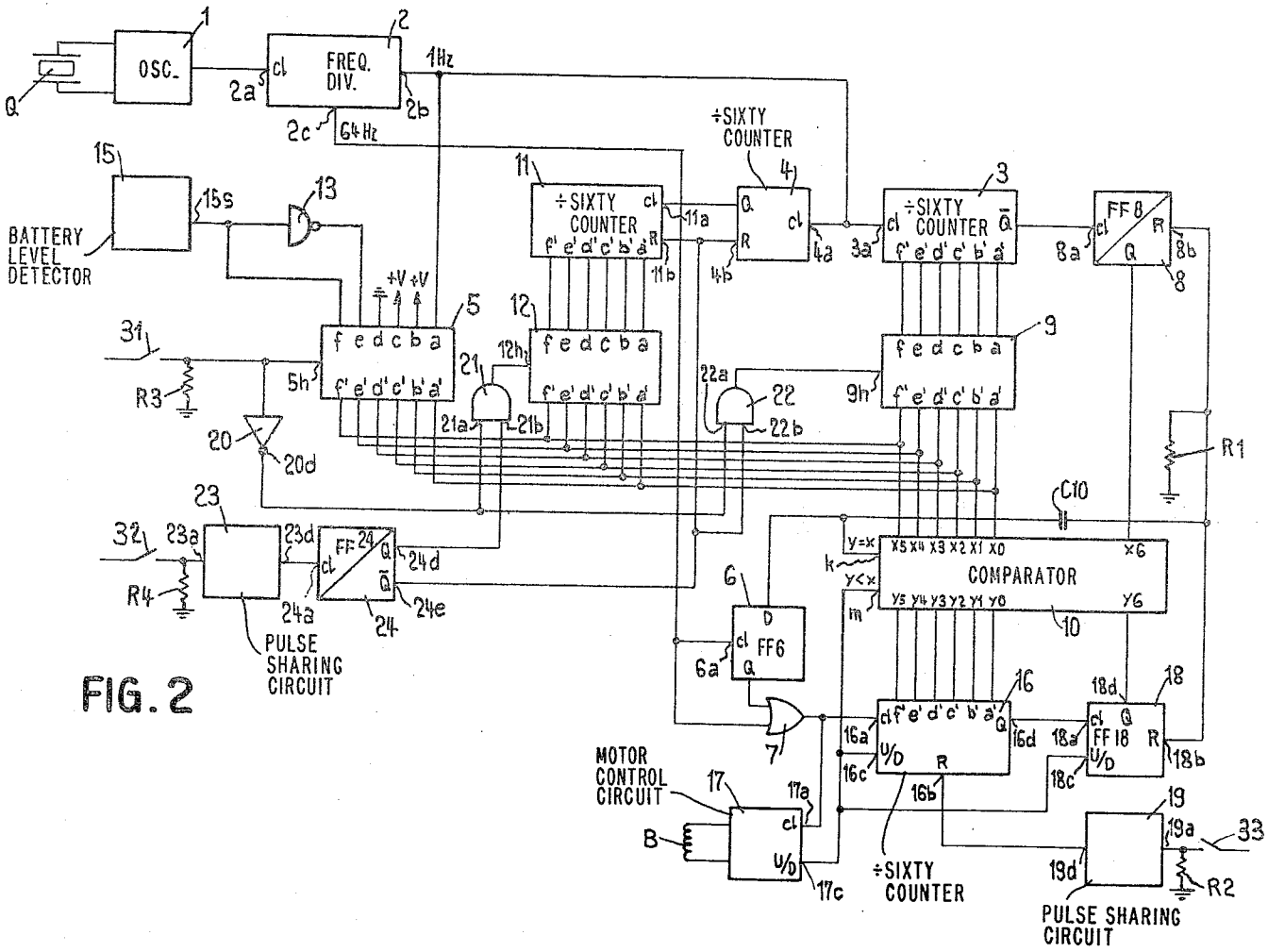
FIG. 2 is a block diagram of one embodiment of an electronic circuit used in the watch shown in FIG. 1 in accordance with the present invention.

The internal electronic circuits of the integrated circuit are shown by the block diagram of FIG. 2, with the exception of the time setting circuits which do not come into the description of the invention.

The output of an oscillator 1 is connected to a clock input 2*a* of a frequency divider 2. A first output 2*b* of this divider 2, which delivers a 1 Hz frequency signal, is connected to the clock inputs 3*a* and 4*a* of two divide by sixty counters, 3 and 4, each composed of six flip-flops, and is also connected to an input 5*a* of a circuit 5 composed of six transmission gates. This circuit 5 can be controlled by a signal applied to its input 5*h* in such a manner that its outputs 5*a'* to 5*f'* change to the state of the corresponding inputs 5*a* to 5*f* when the input 5*h* is at state 1, and change to a high impedance state, independent of the state of the inputs, when 5*h* is at state 0. The outputs 5*a'* to 5*f'* of the circuit 5 are connected to six inputs X0 to X5 of a first group of inputs of a seven bits comparator 10. The seventh input X6 of the first group is connected to the Q output of a flip-flop FF8. A second output 2*c* of the divider 2, which delivers a 64 Hz frequency signal, is connected to the clock input 6*a* of a D-type flip-flop FF6, and also to the first input of an OR gate 7, the second input of which is connected to the Q output of FF6. The inverted output $\overline{Q}$ of the last flip-flop of the counter 3 is connected to the clock input 8*a* of the FF8, functioning as a divide by two counter. The outputs 3*a'* to 3*f'* of the six flip-flops of the counter 3, having logic states which represent the state of the counter 3 in binary form, are connected to the inputs 9*a* to 9*f* of transmission gates 9, identical to the gates of the circuit 5. The outputs 9*a'* to 9*f'* of the gates 9 are connected to the inputs X0 to X5 of the comparator 10.

The Q output of the last flip-flop of the counter 4 is connected to the clock input 11*a* of a divide by sixty counter 11. The outputs 11*a'* to 11*f'* of the six flip-flops of the counter 11 are connected to the inputs 12*a* to 12*f* of transmission gates 12, identical to the gates of the circuits 5 and 9. The outputs 12*a'* to 12*f'* of the gates 12 are also connected to the inputs X0 to X5 of the comparator 10. The inputs 5*b* and 5*c* of the gates 5 are connected to the positive sale of the supply voltage which corresponds to the logic state 1. The input 5*d* is connected to negative sale of the supply voltage, which corresponds to ground, and to the logic state 0. The input 5*e* is connected to the output of an inverter 13, the input of which is connected to the output 15*s* of a battery level detector 15, and the input 5*f* is directly connected to the output 15*s* of the detector 15. The output of the OR gate 7 is connected to clock inputs 16*a* and 17*a* of a bidirectional-type divide by sixty counter 16, and of a motor control circuit 17 respectively, providing forward or backward driving pulses to a driving coil B. The six outputs 16*a'* to 16*f'* of the counter 16 are connected to six inputs Y0 to Y5 of the second group of inputs of the comparator 10. The output 16*d* of the counter 16 is connected to the clock input 18*a* of a flip-flop FF18 functioning as a bidirectional divide by two counter. The Q output of the counter 18 is connected to the seventh input Y6 of the second group of inputs of the comparator 10.

The comparator 10 has a first output k corresponding to the equality Y=X between the logic states of the inputs of the first and of the second group. This output k is connected to the D input of FF6 and, via a series capacitor C10, to the reset inputs of FF8 and FF18, and also to a terminal of a resistance R1, the other terminal of which is connected to ground. The comparator 10 also has a second output m corresponding to the inequality Y<X between the logic states of the inputs of the first and of the second groups. The output m is connected to the inputs 16*c* and 17*c* of the forward-/backward control of the counter 16 and of the motor control circuit 17.

The contact 33 is connected to ground by a resistance R2, and to the input 19*a* of a pulse shaping circuit 19. The output 19*d* of pulse shaping circuit 19 is connected to the reset input 16*b* of the counter 16.

The contact 31 is connected to ground by a resistance R3, to the control input 5*h* of the gates 5, and to the input of an inverter 20. The output 20*d* of inverter 20 is connected to the first inputs 21*a* and 22*a* of the two AND gates 21 and 22.

The contact 32 is connected to ground by a resistance R4, and to the input 23*a* of a pulse shaping circuit 23, the output 23*d* of which is connected to the clock input 24*a* of a flip-flop FF24. The Q output 24*d* of FF24 is connected to the second input 21*b* of the gate 21, while its inverted output 24*e* is connected to the second input 22*b* of the gate 22 and to the reset inputs 4*b* and 11*b* of the counters 4 and 11. The outputs of the gates 21 and 22 are respectively connected to the control inputs 12*h* and 9*h* of the gate circuits 12 and 9.

The functioning of the circuit is as follows:

The oscillator 1 delivers a precise frequency signal to the input 2*a* of the divider 2. This divider 2, in turn, delivers a 1 Hz signal to the input 3*a* of the binary divide by sixty counter 3 which delivers a signal every sixty seconds to the clock input 8*a* of the FF8. The counter 3 and FF8 constitute a seconds counter having a capacity of twice sixty seconds. The state of the counter 3 is represented by a six bit parallel binary information which is present on the six outputs 3*a'* to 3*f'* of this counter, and is supplied to the corresponding inputs 9*a* to 9*f* of the gates 9. The FF6 receives on its clock input 6*a* the 64 Hz signal of the output 2*c* of the divider 2, and if its Q output is at 0, the gate 7 is enabled and the 64 Hz signal appears at the clock inputs 16*a* and 17*a* of the bidirectional binary divide by sixty counter 16 and of the motor control circuit 17 respectively. The detail of this motor control circuit is not shown, as it depends on the type of motor used. Such control circuits have already formed the subject of descriptions given by various manufacturers. It is disclosed, in the following description, that the motor and the counter 16 advance simultaneously by one step when the forward/backward inputs 17*c* and 16*c* of the circuit 17 and of the counter 16 are at the state, and conversely, go back one step when these inputs are at the state 0.

On the other hand, the pulse shaping circuit 19 provides a reset pulse to the input 16*b* of the counter 16 when the contact 33 closes, actuated by the cam 35 secured to the gear train. It is known (see FIG. 1) that the contact closes when the seconds hand passes through 0, wherein it is unimportant, that this passage to 0 be effected by an advance or a return of one second of this hand, which corresponds to one step of the motor, simultaneously with the counter 16. This counter 16 is thus synchronous with the seconds hand and its state corresponds to the position of the seconds hand on the dial. This state is represented by six bit parallel binary information, present on the six outputs 16*a'* to 16*f'* of the counter 16 connected to the inputs Y0 to Y5 of the comparator 10. The counter 16 also delivers through its output 16*d*, at each counting cycle, a clock signal to the input 18*a* of the counter 18. The output representing the state of this counter is connected to the input Y6 of the comparator 10. The counters 16 and 18 form a bidirectional counter having a capacity of twice sixty motor steps.

The gates 5, 9 and 12 form an information selector. These gates have the characteristic already indicated previously, of having their outputs at high impedance when their control inputs are, for example, at 0. It is thus possible to connect the outputs of several gates in parallel, ensuring that only one of these gates, 5, 9 or 12 is enabled at a given instant, so that only one of the control inputs is then at 1. It is the information present at the inputs of this gate which will appear at its outputs and thus at the inputs X0 to X5 of the comparator 10.

Normally the contacts 31 and 32 are open, and FF24 is in the state 0. Its inverted output 24*e* is thus at the state 1, as is the output 20*d* of the inverter 20. The control input 5*h* of the gate 5 is in the state 0, as is the control input 12*h* of the gate 12, while the output of the gate 22, connected to the control input 9*h* of the gates 9, is at logic state 1. It is thus the information present at the inputs of the gates 9 which is transmitted to the inputs X of the comparator 10, i.e., the information delivered by the outputs 3*a'* to 3*f'* of the seconds counter 3. This information is thus compared with the information Y. If Y=X (equal for example to 59, or in binary code 0111011), the output k of the comparator 10 is in the state 1, as is the Q output of FF6. The gate 7 receives on its second input the signal of logic state 1 from the Q output of FF6; thus, the output of gate 7 goes to logic state 1, so that the 64 Hz signal present on the first input of gate 7 is not transmitted to its output. The counter 16 and the control circuit of the motor 17 thus do not receive a clock signal. The seconds hand occupies the position 59 on the dial, corresponding to the contents of the seconds counter 3. On the next 1 Hz pulse delivered by the divider 2, the counter 3 passes to the state 0, and FF8 is at the state 1. The information X thus passes to the state 1000000 and is compared with the information Y remaining at the state 0111011. The output k of the comparator 10 passes to the state 0, while its output m passes to 1, because the inequality Y<X is satisfied.

The Q output of FF6 passes to the state 0, and enables a first 64 Hz frequency clock signal to pass to the output of the gate 7. This signal produces the advance, by one step, of the counter 16 and simultaneously the advance, by one step, of the motor. The seconds hand passes from 59 to 0, and the counter 16 passes from 59 to 0, which makes the counter 18 pass to the state 1.

The information Y then becomes Y=1000000=X. The output k of the comparator 10 returns to the state 1, as does the Q output of FF6. The second input of gate 7 is again at the logic state 1, so that the 64 Hz signal present on its first input is again prevented from appearing at its output. Simultaneously, the capacitor C10 delivers a reset pulse to the input 8*b* of FF8 and to the input 18*b* of the counter 18, so that the inputs X and Y take up the same state 0000000. The FF8 and the counter 18 thus ensure a correct passage from one minute to the next, the seconds hand not having to go backwards from 59 to 0.

Thus, at each second, the seconds counter 3 progresses by one step, the output k of the comparator 10 passes to the state 0, and the seconds hand and the counter 16 advance simultaneously by one step which re-establishes the equality Y=X, which then stops the motor until the next seconds signal.

The watch thus operates in a normal manner as long as the information delivered by the seconds counter 3 is delivered by the gates 9 to the inputs X of the comparator 10.

Let us see how functions other than the seconds can be displayed by means of the seconds hand.

Two circuits for effecting auxiliary functions are shown by way of example. The first, composed of the seconds counter 4 and of the minutes counter 11, both having a capacity of sixty, form a chronograph having a capacity of sixty minutes, which can be used, for example, for measuring diving times. The chronograph is controlled by the contact 32. The minutes counter 11 delivers a six bits parallel binary information to the inputs 12*a* to 12*f* of the gates 12.

The second circuit for effecting an auxiliary function is the voltage level detector of the battery 15. The detail of this circuit does not come into the description of the invention and is thus not shown. This circuit delivers a logic state signal 0 when the voltage of the battery is greater than a predetermined level, and conversely a logic state signal 1 when this voltage is less than the predetermined level. The signal modifies the information present at the inputs 5*e* and 5*f* of the gates 5, respectively connected via an inverter 13, and directly, to the output 15*s* of the circuit 15. When the signal is at the state 0, the input information 5*a* to 5*f* is comprised between the values 010110 and 010111, and thus oscillates between 22 and 23, the bit 5*a* (the least significant) being pulsed at the seconds rhythm. When the signal is at the state 1, the input information varies between 100110 and 100111, and thus oscillates between 38 and 39. The display of the information of the second auxiliary circuit is controlled by the contact 31 actuated by the pushbutton P1.

When the contact 32 is closed, the pulse shaping circuit 23 delivers a clock pulse to FF24, which passes to the state 1. The control input 12*h* of the gate 12 passes to the state 1. The inverted output 24*e* of FF24 passes to the state 0, which frees the reset inputs 4*b* and 11*b* of the counters 4 and 11 which start to count, and forces the control input of the gate 9 to pass to the state 0. Thus, it now the information at the inputs of the gates 12 which is transmitted to the inputs X0 to X5 of the comparator 10, the input X6 remaining connected to the Q output of FF8. The information at the inputs X0 to X5 is 000000, and progresses by one unit per minute.

Let us assume that the seconds hand is at this instant in the position 48 of the dial. The corresponding information Y is then 0110000. Y being greater than X, the output k of the comparator passes to the state 0 as does the output m. The output of FF6 passes to the state 0 and enables the gate 7. This allows the 64 Hz frequency signals of the divider 2 to pass to the clock inputs 17*a* and 16*a* of the control circuit 17 of the motor and of the counter 16, which are controlled in backward motion by the output m of the comparator 10, which is now in the state 0. The seconds hand, and the counter 16, are thus displaced backwardly at a rapid pace of 64 steps per second, until they arrive at the position 0. At this moment, the information Y=X=0000000 and the output k of the comparator 10 passes to the state 1, as does the Q output of FF6. The second input of gate 7 is again at the logic state 1, so that the 64 Hz signal present on its first input is again prevented from appearing at its output. The counter 16 and the seconds hand remain in the position 0, which corresponds to the contents of the counter 11.

After 12 seconds, the counter 3, which continues to count the seconds, has passed from 48 to 59 and then returns to zero, changing the FF8 to the state 1. The information X then becomes 1000000, Y having remained at 0000000. The output k of the comparator 10 passes to the state 0 and its output m passes to the state 1, because the inequality Y<X is satisfied. The gate 7 is enabled, allowing the 64 Hz frequency signals to again pass to clock inputs 17*a* and 16*a*. The circuit 17 and the counter 16 are controlled forwardly. The seconds hand and the counters 16 and 18 advance rapidly forward by 64 steps per second until Y comes to 1000000=X. The output k returns to the state 1, and the second input of gate 7 is again at the logic state 1, so that the 64 Hz signal present on its first input is again prevented from appearing at its output. The seconds hand and the counter 16 are thus blocked, while the FF8 and the counter 18 are returned to the state 0, so that X and Y both pass to the state 0000000. The seconds hand is again in the position 0 and has thus effected one complete turn of the dial. This operation repeats itself at each minute and thus permits the correct display of the minutes and hours hands to be maintained, even when the seconds hand is no longer used for displaying the seconds value.

When the minutes counter 11 changes to the state 000001, the information X becomes 0000001 and the equality Y =X disappears, so that the output m is in the logic state 1. The seconds hand (through control circuit 17 and the motor) and the counter 16 advance by one step and come into the position 1, then reestablishing the equality Y=X so that, the seconds hand and the counter 16 are maintained in this position, which corresponds to the contents of the minute counter 11. The user can thus read the position of the seconds hand on the seconds scale of the timepiece. This position of the seconds hand indicates the number of minutes which have elapsed from the instant when the user has actuated the pushbutton P2, while the minutes and hours hands still indicate the correct time (hour and minute).

Summarizing, when information is selected from the minutes counter 11, the seconds hand rapidly proceeds at the rate of 64 steps per second to the position of the dial corresponding to this information. The hand is displaced forwards or backwards so as to remain in the same minute. When the time passes into the following minute, the seconds hand is rapidly displaced forward by 60 steps (one complete turn) to advance the minutes hand by one unit, and thus maintain the correct display of the time by means of the minutes and hours hands.

If the user again presses the pushbutton P2 and closes the contact 32, FF24 returns to the state 0. The output of the gate 21 goes to the state 0, and the output of the gate 22 goes to the state 1. The counters 11 and 4 are reset to zero. It is again the information at the outputs of the seconds counter 3 which is selected at the inputs X of the comparator 10, and the seconds hand, moves, forward or backward, within the same minute, to the position corresponding to the value of the seconds, and takes up its normal movement by steps of one second.

Let us now see what happens when the user presses pushbutton P1 and closes the contact 31. The control input of the gates 5 passes to the state 1 while the output of the inverter 20 passes to the state 0, which places the control inputs of the gates 9 and 12 at the state 0. It is thus the information present at the inputs of the gates 5 which is transmitted to the inputs X of the comparator 10. We have already seen that this information varies between 22 and 23 when the battery is good. The seconds hand will thus come to oscillate between these two positions of the dial, designated by a green index corresponding to the indication "battery good". If on the other hand, the voltage of the battery is insufficient, the information at the inputs of the gates 5 oscillate between 38 and 39. The seconds hand will then come to oscillate between these two positions of the dial, designated by a red index corresponding to a "defective battery". Thus, the user can, by simple pressure on P1, determine the state of the battery. When P1 is released, the seconds hand returns to the preceding mode, either the display of the value of the seconds, or the display of the minutes chronograph.

One could also have a measuring circuit for the battery delivering information corresponding to the value of the voltage thereof, with the seconds hand moving into a position on the dial corresponding to the value of the voltage of the battery, e.g., the position 15 when its voltage is 1.5 volts.

In the same manner one could display by means of the seconds hand any other auxiliary function realized by the measuring, counting or memorizing circuits comprised in the integrated circuit, as far as these circuits deliver information compatible with the circuit of FIG. 2.

Thus, there can be envisaged the display of the cardiac rhythm or of the temperature of the user, the phases of the moon, the bio-rhythm, etc.

What is claimed:

1. An electronic timepiece comprising:

a power source, means for producing data relative to the seconds of the actual time and a signal relative to the minutes of the actual time, means for producing actual time independent data, means for selecting either said data relative to the seconds of the actual time or said actual time independent data in response to a first manually produced control signal, a bidirectional stepping motor responsive to forward or backward driving pulses, a seconds hand driven by said motor, a minutes hand and an hours hand coupled to said seconds hand, means for producing data relative to the position of said seconds hand in response to control pulses, means responsive to the difference between said selected data and said seconds hand position data and to the sign of said difference for producing said control pulses and either said forward or said backward driving pulses, to cause said motor to drive said seconds hand to a position corresponding to said selected data, and means for producing a predetermined number of said forward driving pulses in response to said minutes signal when said selected data is said actual time independent data, to cause said motor to drive said seconds hand for a complete clockwise turn, said minutes hand and said hours hand thus always indicating the minutes and the hours of the actual time.

2. The electronic timepiece of claim 1, wherein said actual time independent data producing means comprises elapsed time counting means responsive to a second manually produced control signal and to time base pulses for producing elapsed time data.

3. The electronic timepiece of claim 1, wherein said actual time independent data producing means comprises voltage level detector means for producing voltage level data in response to the voltage level of said power source.

4. The electronic timepiece of claim 1, further comprising means for producing a reset signal when said seconds hand reaches a predetermined position, wherein said seconds hand position data producing means are further responsive to said reset signal for producing a predetermined seconds hand position data.

* * * * *